United States Patent [19]

Cerny et al.

[11] 3,973,496

[45] Aug. 10, 1976

[54] APPARATUS FOR MOUNTING AND LOCKING PRINTING PLATES

[75] Inventors: Daryl D. Cerny, Greenville, Ohio; Robert W. Cannon, Muncie, Ind.; Robert E. Okeley, II, Yorktown, Ind.; Joseph L. Sannella, Muncie, Ind.

[73] Assignee: Ball Corporation, Muncie, Ind.

[22] Filed: Sept. 17, 1975

[21] Appl. No.: 614,037

Related U.S. Application Data

[60] Division of Ser. No. 410,580, Oct. 29, 1973, which is a continuation of Ser. No. 272,604, July 17, 1972, abandoned.

[52] U.S. Cl. ..... 101/415.1; 101/378

[51] Int. Cl.[2] ..... B41F 27/14

[58] Field of Search ..... 101/415.1, 378

[56] References Cited

UNITED STATES PATENTS

| | | | |
|---|---|---|---|
| 2,108,822 | 2/1938 | Lippencott | 101/378 |
| 2,265,005 | 12/1941 | Read | 101/415.1 |
| 2,801,856 | 8/1957 | Medowar | 101/378 |
| 3,470,817 | 10/1969 | Heimlicker et al. | 101/378 |
| 3,416,447 | 12/1968 | Pozniak | 101/415.1 |
| 3,603,255 | 9/1971 | Horner | 101/415.1 |
| 3,696,744 | 10/1972 | Etchell | 101/415.1 |
| 3,750,572 | 8/1973 | Etchell et al. | 101/378 |
| 3,766,857 | 10/1973 | Schlatter | 101/415.1 |
| 3,771,449 | 11/1973 | Hill | 101/415.1 |
| 3,791,295 | 2/1974 | Albright | 101/415.1 |

FOREIGN PATENTS OR APPLICATIONS

| | | | |
|---|---|---|---|
| 1,200,991 | 8/1970 | United Kingdom | 101/378 |

*Primary Examiner*—Edgar S. Burr
*Assistant Examiner*—William Pieprz
*Attorney, Agent, or Firm*—James D. Haynes

[57] ABSTRACT

This invention relates to an improved apparatus and method for locking printing plates to a support, e.g., saddle or cylinder, wherein the support includes a body portion having at least two anchoring means as an integral part thereof, at least one of the anchoring means being incorporated on a spring-mounted bar movable under spring tension to engage and lock printing plates to the support. The invention also relates to apparatus and method for mounting printing plates onto a support comprising an actuating assembly for the spring-mounted bar and which is adapted to move the spring-mounted bar between expanded and compressed positions for the mounting. The spring-mounted bar actuating assembly is mounted beneath the peripheral surface of the support and comprises a pivot arm pivotable at or near its midpoint about a pivot block which is mounted beneath the peripheral surface. The pivot arm, at one end, is connected through a strap to the spring-mounted bar at the midpoint position of the spring-mounted bar and, at the other end, protrudes from one side of the support and is adapted to receive an actuating means such as a cam assembly for actuating the spring-mounted bar. Additionally, printing plates with preshaped engaging means of a shape complementary to that of the anchoring means of lock-up device are provided.

5 Claims, 18 Drawing Figures

APPARATUS FOR MOUNTING AND LOCKING PRINTING PLATES

This application is a divisional of our copending application Ser. No. 410,580 filed on Oct. 29, 1973, which is a continuation Application of Ser. No. 272,604, filed on July 17, 1972, now abandoned and entitled "Apparatus and Method for Mounting And Locking Printing Plates". application This invention relates generally to apparatus and methods for locking flexible and thin printing plates to a support for use in high-speed printing press operations in existing presses and cylinders.

In a printing press operation, the press cylinders are of necessity in close proximity with each other. The method generally employed to attach a plate to a support is to bring the leading edge of a saddle into working position by inching or rotating the press cylinder, attaching the printing plate to the saddle, thereafter, while maintaining a hold on the printing plate, further slowly rotating the press cylinder to bring the trailing edge of the saddle into working position, and attaching the trailing edge of the plate to the trailing edge of the saddle. This is a slow process. Moreover, this method necessitates the body members of an operator to be in close proximity to the moving parts of the press rolls during press inching creating a potential safety hazard. It is highly desirable to provide for apparatus and method which provides for the mounting of printing plates while the press rolls can be maintained in a static position.

Moreover, while various means of attaching plates to a support have been devised to assure that printing plates will not ride loosely on their support during printing or will not be thrown off during high speeds, there has been no convenient method or device for coping with expansion of the printing plate which occurs after the plate has been exposed for a short while to a press operation. Some of the known means for locking printing plates include adhesives, bolts, screws, etc. When plate expansion does occur under circumstances where conventional locking means have been employed, it has been found necessary to shut down the printing operation for making adjustments. The adjustment has usually required removal of the saddle or cylinder and/or inching the press to rotate the securing mechanism to accessible position for adjustment. It is desirable to provide for a lock-up means which is not rendered ineffective by plate expansion.

Although more recent developments have provided lock-up devices which hold a plate under resilient tension, thereby providing some means for coping with plate expansion, certain deficiencies are associated with them. Generally, the devices providing resilient tension are inadequate to meet the pressures exerted by high-speed operations. In certain cases, other deficiencies are noted, such as the necessity for screwing on plates thereby requiring press inching for mounting. In still other cases, substantial modification of the cylinder may be necessary to provide for tensioning devices. In such latter cases, the mechanism is not adaptable for use with existing press cylinders.

According to the present invention, a mechanism is provided for locking a printing plate to a support under a continuous self-adjusting tension so that appropriate tension is maintained even during high-speed press operations. The mechanism, which is competent to maintain printing plates in a locked position in spite of plate expansion, is an integral part of a support and may be incorporated into the structure of a saddle to be employed with existing cylinders or may be made a part of a modified cylinder. Moreover, by providing a mechanism employing compression springs, maximum force may be obtained in a minimum of space. The present invention further provides a quick and convenient method and apparatus for mounting and locking a printing plate on a support while the press roll is maintained in a static position, i.e., without the need for press inching between the mounting of the leading and trailing edges of a printing plate. In addition, a lock-up device is provided which avoids the need for making a plurality of individual adjustment of plate fastening means. Further, alternative devices for mounting plates are provided for use with the lock-up mechanism. The lock-up device of the present invention allows high-speed press operations with a minimum of shut-down time for plate changes and, further, avoids the necessity for readjusting a plate once the plate is locked into its support.

The accompanying drawings illustrate a preferred embodiment of the invention in which.

Figure 7:
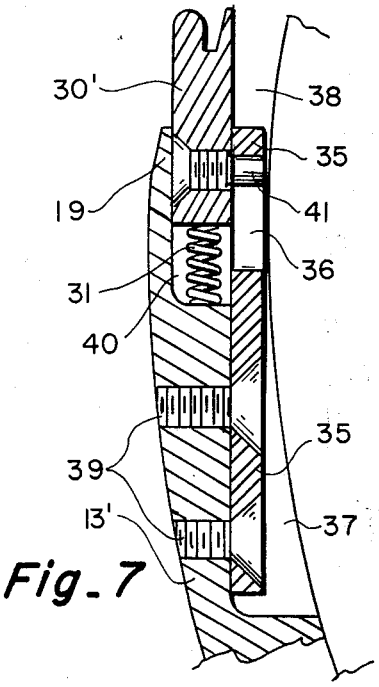
Figure 6:
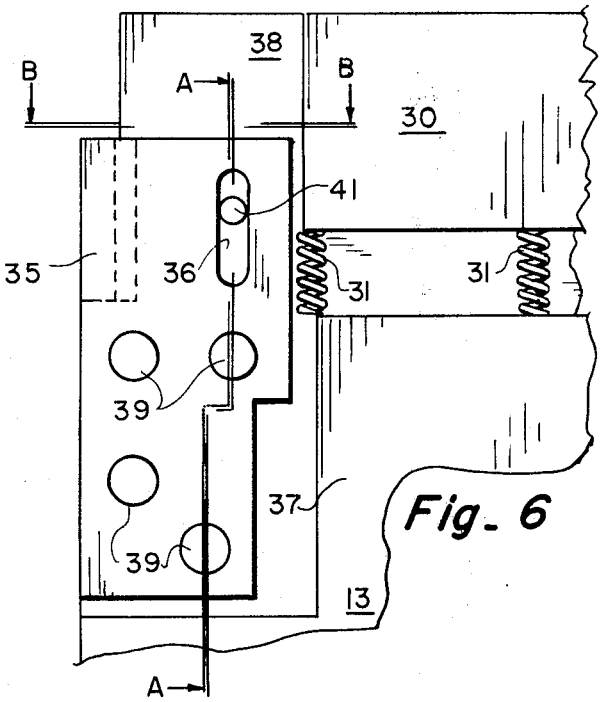
FIG. 6 is a fragmentary underside view of one corner of the trailing edge of the saddle showing the saddle, the spring-mounted bar and a retaining and guiding clip.
Figure 6A:
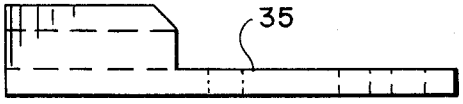
Figure 6B:
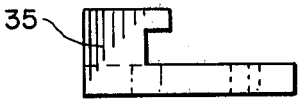
Figure 9:
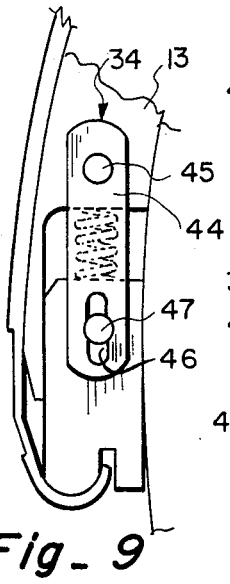
Figure 8:
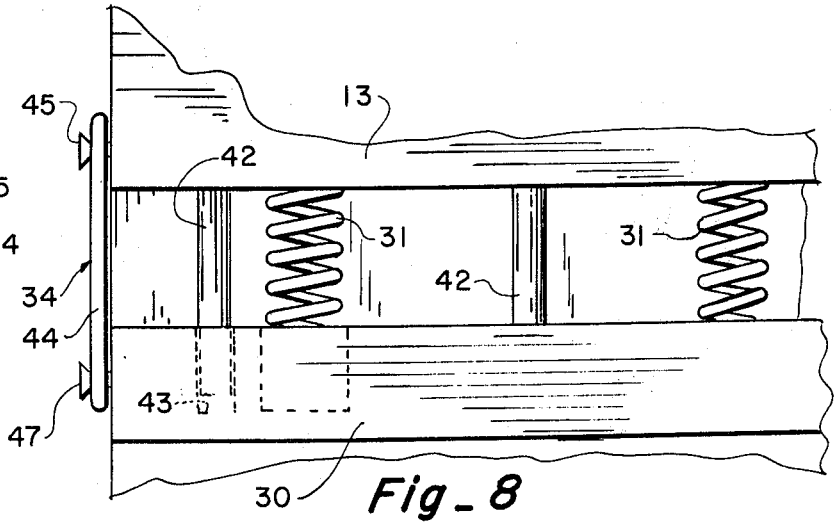
Figure 10:
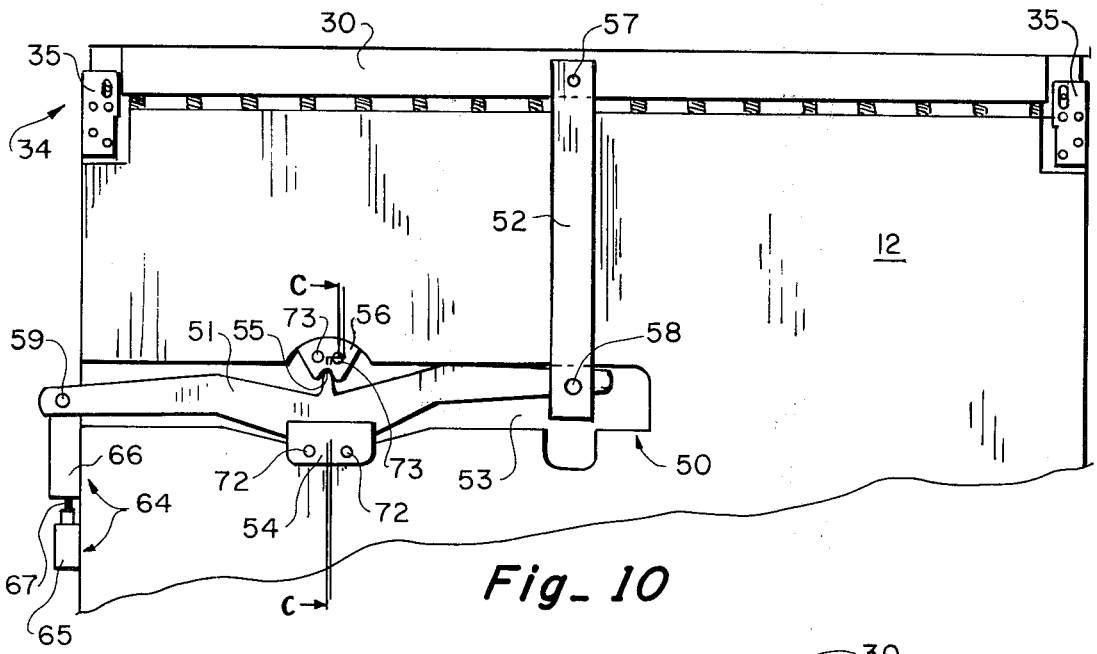
Figure 11:
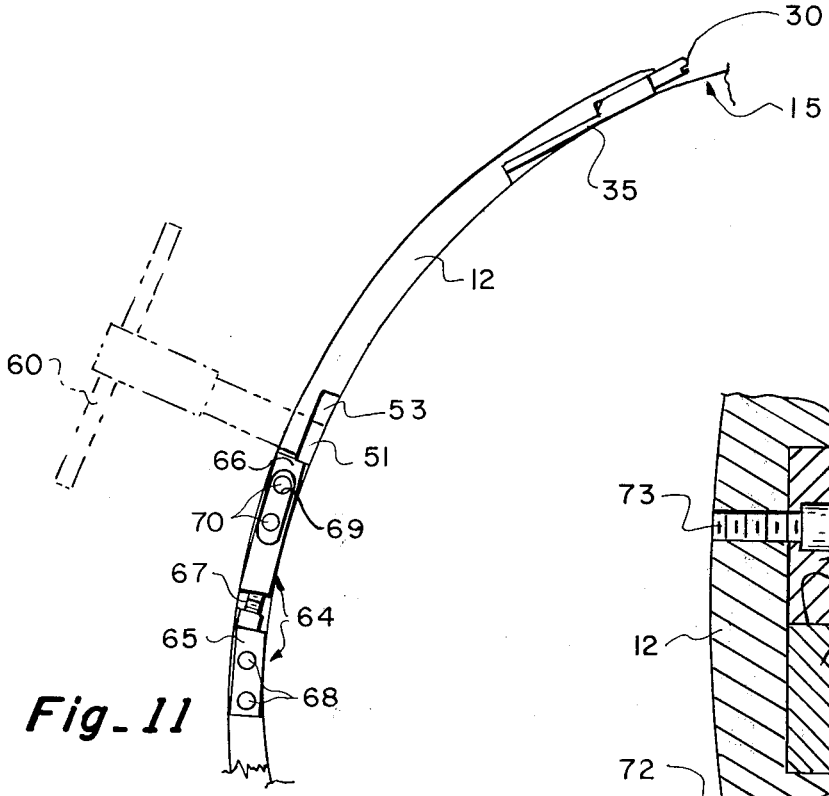
Figure 12:
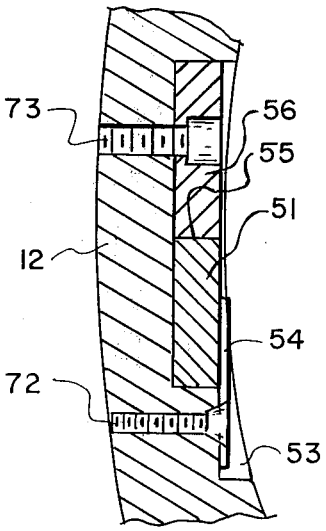
Figure 13:
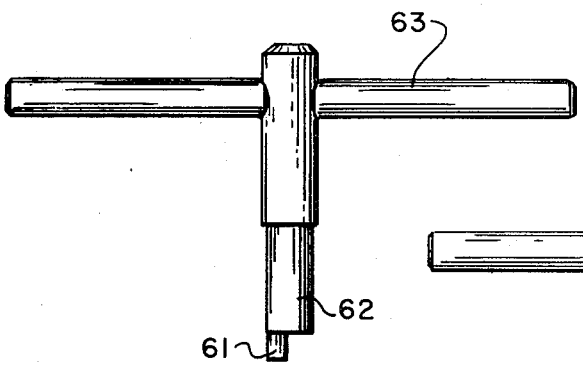
Figure 14:
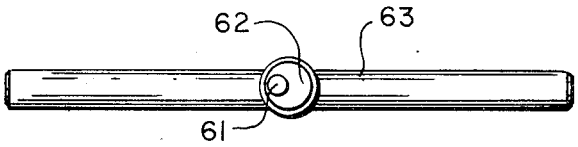

FIGS. 6*a* and 6*b* illustrate preferred profiles for the retaining and guiding clip;

FIG. 7 is a cross-sectional view taken along A—A of FIG. 6;

FIG. 8 is a fragmentary underside view of one corner of the trailing edge of the saddle showing the saddle, the spring-mounted bar, the guide pins and the retaining bar;

FIG. 9 is a side view at the trailing edge showing one form of retaining means;

FIG. 10 is a partial plan view of the underside of the trailing edge of the saddle showing a centrally positioned cam activated spring-mounted bar actuating assembly and the retaining and guiding means;

FIG. 11 is a partial side view of the saddle showing the trailing edge including the spring-mounted bar and the cam block assembly;

FIG. 12 is a cross-sectional view taken along C—C of FIG. 10;

FIGS. 13 and 14 show the side and bottom views of the cam tool; and

Figure 15:
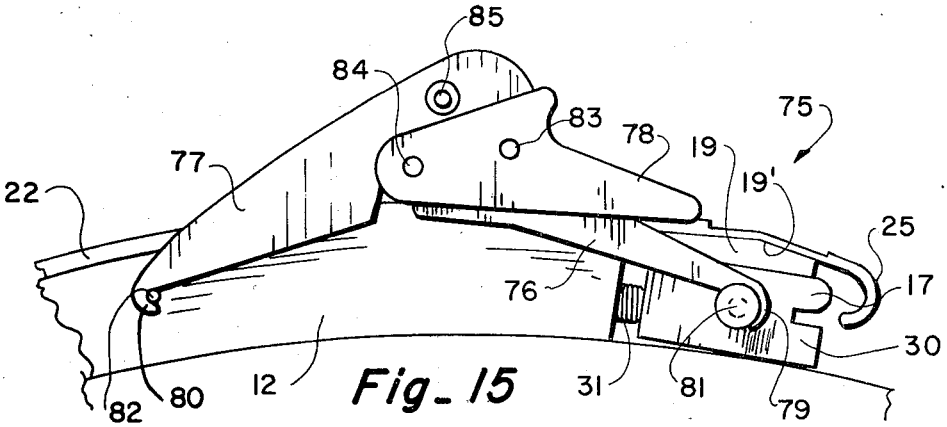
Figure 16:
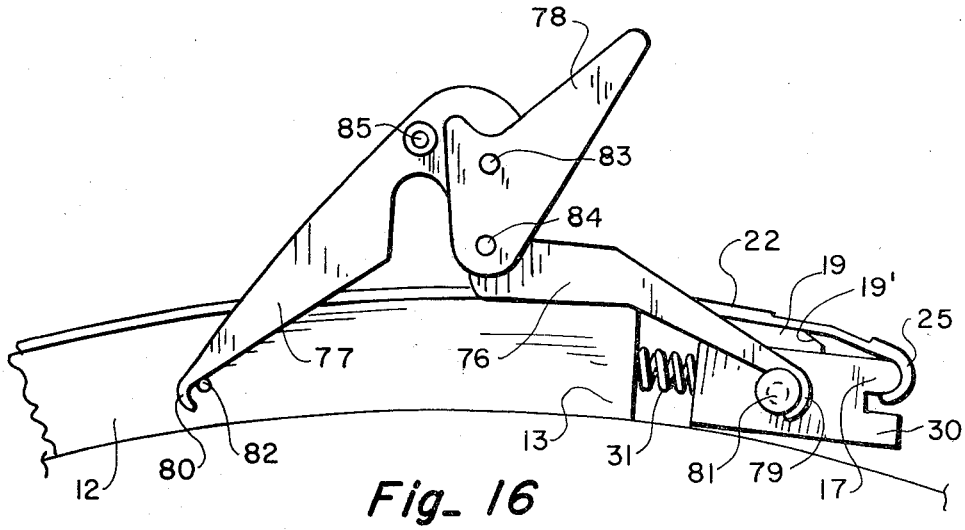

FIGS. 15 and 16 are fragmentary enlarged side views of the locking apparatus showing one of the laterally positioned toggle spring-mounted bar actuating assembly.

Figure 1:
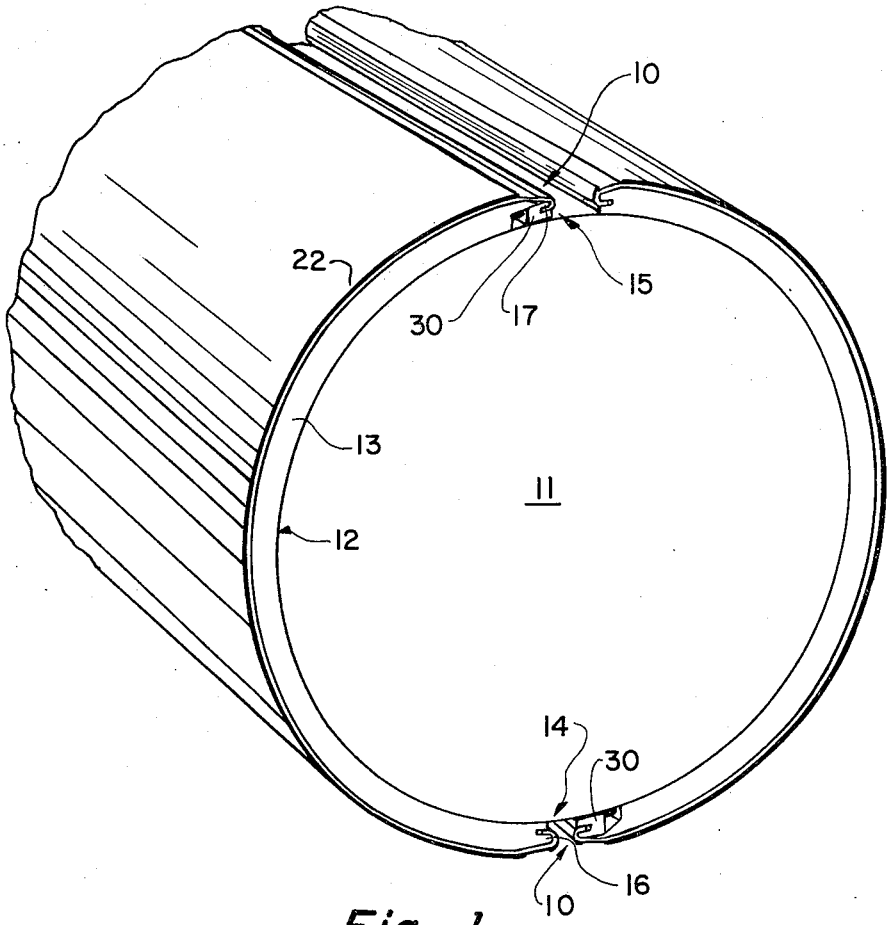
FIG. 1 is a partial perspective view of a printing plate locked to a saddle mounted on a press cylinder.
Figure 2:
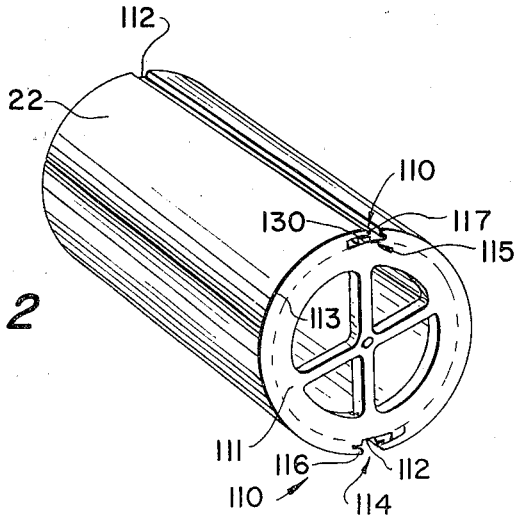
FIG. 2 is a perspective view of a printing plate locked directly to a modified press cylinder.

Reference is now made to the drawings where FIGS. 1 and 2 illustrate two embodiments of an arangement for locking a printing plate to a support wherein the lock-up machanism is assigned a reference number terminating in numerals 10.

FIG. 1 illustrates an embodiment of this invention in which the support is a saddle 12. A printing plate 22 is mounted on a saddle 12 having a lock-up mechanism 10 as an operable, integral component thereof. The saddle 12, substantially semi-cylindrical and curved for securement to a cylinder 11, is adapted to be mounted thereon by conventional means and used on a printing press (not shown). The saddle 12 has a body portion 13 and leading and trailing edges 14 and 15, respectively, which are oppositely disposed and are parallel to the axis of the curvature of saddle. Both the leading and trailing edges 14 and 15 are provided with plate anchoring means 16 and 17 which extend along the entire length of the leading and trailing edges and are adapted to receive the engaging means (hereinafter described) of a printing plate. The plate anchoring means 16, along the leading edge 14, is incorporated directly on the body portion 13 at its forward face. The plate anchoring means 17, along the trailing edge 15, is incorporated on a movable spring-mounted bar 30, operably, non-detachably connected to the body portion 13 of the saddle 12 at its trailing edge 15.

FIG. 2 illustrates a second embodiment of this invention wherein the support is a modified cylinder 111 adapted for use in a printing press (not shown). A printing plate 22 is mounted directly to a modified cylinder 111 having the lock-up mechanism 110 as an operable and integral component thereof. The lock-up mechanisms 110 are situated in the peripheral channels 112 oppositely positioned on the cylinder 111. Each channel separates the leading and trailing edges 114 and 115, respectively, of each peripheral body portion 113 of the cylinder 111. Each channel 112 is provided with two plate anchoring means 116 and 117 extending along the entire length of the leading and trailing edges 114 and 115, respectively. Plate anchoring means 116 are incorporated along the leading edges 114 of each peripheral body portion. Plate anchoring means 117, along the trailing edges 115, are incorporated on movable spring-mounted bars 130, operably non-detachably connected to the peripheral body portion 113 of the cylinder 111.

Figure 3:
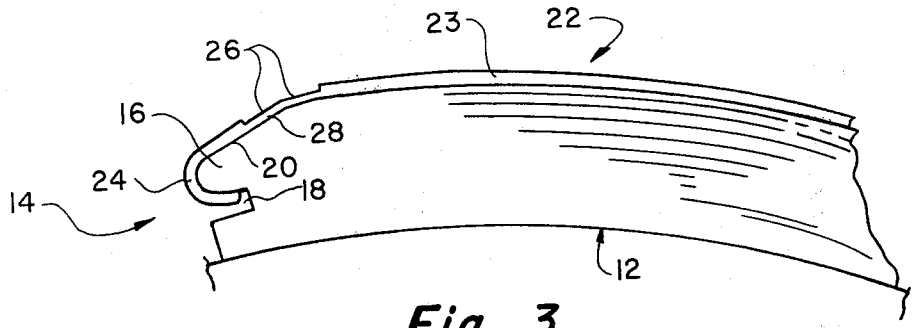
FIG. 3 is a fragmentary enlarged cross-sectional view of a saddle with a printing plate attached at the leading edge.
Figure 4:
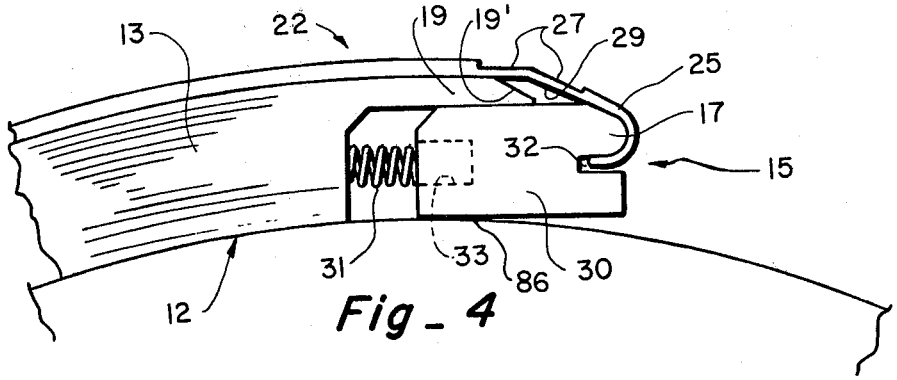
FIG. 4 is a fragmentary enlarged cross-sectional view of the trailing edge of a saddle at a point inward of the lateral edge showing a printing plate locked into position with a spring-mounted bar.

Although the locking mechanism is suitable for incorporation both on saddles and modified cylinders, an arrangement in which the mechanism is incorporated in a saddle constitutes a preferred embodiment; and, for purposes of explanation, the specification description which follows will refer to the locking mechanism incorporated in a saddle. The locking mechanism as an integral part of a saddle is illustrated in FIGS. 3 and 4. FIG. 3 shows the lock-up mechanism at the leading edge 14 of saddle 12. The anchoring means 16 is a substantially arcuately shaped lip on the forward face of the saddle defined by a groove 18 and an inwardly sloping outer surface 20. The groove 18 is of sufficient depth to enable the anchoring means 16 to receive the complementary shape engaging means 24 of a printing plate 22 in mating relationship and extends along the entire length of the forward face of the saddle 12.

FIG. 4 illustrates the lock-up mechanism 10 at the trailing edge 15 of saddle 12 provided by a movable spring-mounted bar 30 coacting with projecting edge 19 of saddle 12. The spring-mounted bar 30 has parallel straight top and bottom surfaces and is of a lesser thickness than the thickness of the saddle 12. It is competent to slide under the projecting edge 19 of the saddle and, further, is separated from but operably non-detachably connected to the adjacent body portion 13 of the saddle by a plurality of high-strength compression springs 31 and preferably by guiding and retaining means (herein-after to be described). The compression springs 31 are positioned between the bar 30 and adjacent body portion 13 of said saddle along its entire length and provides substantially uniform tension therealong. The spring-mounted bar 30 is provided with a groove 32 which extends along the entire length of the edge removed from the saddle. The portion of the spring-mounted bar between the groove and its upper or top surface defines a substantially semi-circular forward face providing an arcuately shaped lip as anchoring means 17 adapted to engage and lock thereabout a complementary shaped engaging means 25 of printing plate 22 in mating relationship as seen in FIG. 4. The outer surface 19' of the terminal portion of the projecting edge 19 of the saddle slopes inward of the normal circumferential shape of the saddle while the inner surface is straight and complements the upper surface of the spring-mounted bar 30. The sloping outer surface 19' of the terminal portion of the projecting edge of the saddle provides a substantially continuous support to a complementary shaped terminal portion of printing plate 22 during extension and retraction of the springs 31 in the course of press operation. The contact between the plate and sloping outer surface is maximal when the springs are in the maximum compressed position, such as during the mounting of the plates as seen in FIG. 15. As the springs are extended, as when the plate is locked into position, the terminal portion of the plate is pulled slightly away from the sloping outer surface, as seen in FIG. 4; but, as the plate moves in consonance with the expansion and contraction of the springs 31 and contacts the sloping outer surface 19', the sloping contour facilitates avoidance of damage to the plates and provides necessary relief so that the etched area 27 does not print or "smut".

Figure 5:
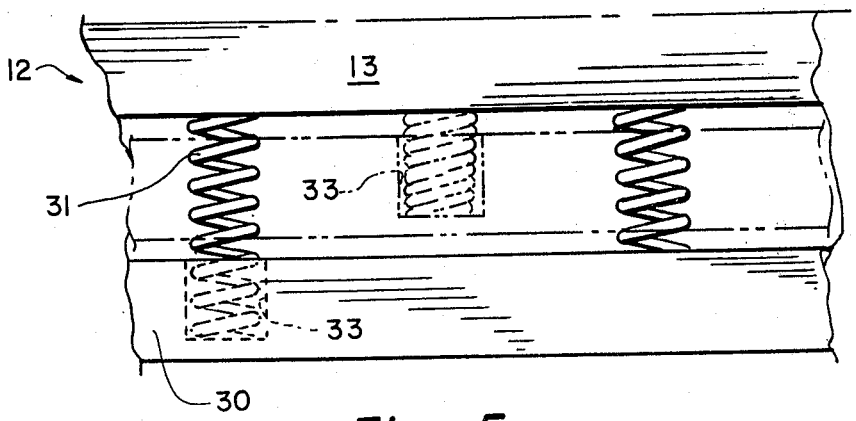
FIG. 5 is an enlarged cut-away bottom view of a section of the lock-up mechanism at the trailing edge of a support at a point inward of the lateral edge showing the body portion of the support and the spring-mounted bar.

FIG. 5 illustrates the expanded and compressed (phantom lines) configuration of the springs 31 which separate the spring-mounted bar 30 from the body portion 13 of saddle 12. The springs 31 are positioned perpendicularly between the body portion 13 of the saddle and spring-mounted bar 30 and act to urge the bar outwardly from the body portion. The springs are so spaced that the pressure is substantially constant along the whole length of the spring-mounted bar 30. A plurality of pockets 33 (shown with phantom lines) are provided for the springs 31 on the spring-mounted bar 30 so that, when the springs are in its maximum compressed position, the spring-mounted bar is substantially contiguous to the body portion 13 of the saddle.

In order to provide for optimum operation and to avoid possible separation of th spring-mounted bar 30 and saddle 12 and further to guide the spring bar in its correct tangential path as it is extended and contracted, the body portion 13 of the saddle and the spring-mounted bar preferably are linked by retaining and guiding means generally identified by reference number 34.

The retaining and guiding means may be incorporated in a device having the dual function of retaining and guiding or may be as separate retaining and guiding devices. While retaining and guiding means 34 may assume various forms, two forms have been found to be particularly useful in association with the two different mounting means to be hereinafter described. One retaining and guiding means is a retaining and guiding clip 35 positioned at the two lateral edges as may be seen in FIG. 10. The retaining and guiding clip 35 together with a modified saddle and spring-mounted bar, as hereinafter described, is arranged to assume a tongue and groove configuration with an arresting provision and thus can provide both retaining and guiding functions. This spring-mounted bar to clip tongue and groove configuration is the preferred retaining and guiding means when the cam activated center-pull, spring-mounted bar actuating assembly (hereinafter to be described) is the mounting means. Another useful form of retaining and guiding means is a guide pin-retaining bar combination in which the guiding and retaining functions are in separate devices. The guide pin-retaining bar combination is the preferred retaining and guiding means when the laterally positioned spring-mounted bar actuating toggle means (hereinafter to be described) is the mounting means.

A construction of the spring-mounted bar to clip tongue and groove configuration employing the retaining and guiding clip 35 may be seen in FIGS. 6, *6a*, *6b* and 7. The spring-mounted bar 30 and the terminal part of the body portion 13 of the saddle are modified slightly at the lateral edges to accomodate clip 35. The modification is in the form of decreasing the thickness of the body portion of the saddle 13 and the spring-mounted bar 30 to the extent corresponding to the thickness of the clip 35, forming areas of modified body portion 13' and modified spring-mounted bar 30' and hollow sections 37 and 38, respectively. FIG. 6 and FIG. 7 taken along A—A of FIG. 6 show the reduced thickness of the body portion of the saddle 13' and spring-mounted bar 30', hollow sections 37 and 38, and the space occupied by the clip 35. Preferably, the lateral forward edge of the clip has the side profile shown in FIGS. *6a* and the end profile taken along B—B of FIG. 6 shown in *6b* to provide for maximum stability and guiding function. As seen in FIG. 7, the clip 35 is fastened at one end to the reduced body portion 13' of the saddle by fastening means 39 and, at the other end, protrudes from the body portion and coacts with projecting edge 19 of the saddle to form a groove 40 into which the modified spring-mounted bar 30' may slide. The groove 40 provided by the clip 35 and projecting edge 19 functions to guide the spring-mounted bar 30 in its correct tangential path, as it is extended and retracted. Further, the spring-mounted bar 30 is fitted with an arresting means such as a peg 41 which protrudes into an elongated clip orifice 36 of the clip 35 and moves in said clip orifice during the expansion and contraction of the springs 31. The abutting of the peg 41 at the forward terminal portion of the orifice 36 functions as a retaining means for the spring-mounted bar 30. Thus, both the guiding and retaining function is accomplished simultaneously by the foregoing tongue and groove configuration of the clip 35, projecting edge 19 and spring-mounted bar 30'.

The retaining and guiding means may be a guide pin-retaining bar combination, as seen in FIGS. 8 and 9. The guide pins 42 may serve to control the maximum compressed position attainable. At this point, the position of the pin is such as to be pressing against the body portion 13 of the saddle at one end andd to slide into oversize holes 43 in the spring-mounted bar 30 at the other end. The retaining bar 44 to be positioned at each lateral edge may be seen in FIGS. 8 and 9 wherein said retaining bar is immovably affixed to the body portion 13 with a fastening means 45 and extends toward the trailing edge and slidably contacts the spring-mounted bar 30. The retaining bar 44 at the end in slidable contact with the spring-mounted bar 30 is provided with a slot 46 (seen in FIG. 9) to permit movement with respect to a retaining pin 47 affixed to the spring-mounted bar. This retaining bar and guide pin combination is a preferred retaining and guiding means when toggle mounting means (FIGS. 15 and 16 and hereinafter described) is to be employed.

The printing plate 22 to be used has a body portion 23 and is provided with engaging means 24 at the leading edge and engaging means 25 at the trailing edge, best seen in FIGS. 3 and 4. The engaging means 24 and 25 of the plate 22 are pre-shaped portions describing an arcuate contour, i.e., a substantially semicircular hook shape, along the entire length of the functional portions and complement the shape of the plate anchoring means 16 and 17. The leading and trailing edges of the plate 22 preferably have etched portions 26 and 27 extending parallel to the transverse width of the plate and positioned between the body portion 23 and the arcuately-shaped engaging means 24 and 25. The etched portions 26 and 27 are reduced sections, i.e., substantially thinner relative to the body portion 23 and to the arcuately-shaped engaging means 24 and 25, and are designed to provide for proper non-printing characteristics. Further, the plate 22 at loci immediately inward from and adjacent to engaging means 24 and 25 at the leading and trailing edges, describe inward slopes 28 and 29, respectively, relative to the normal circumferential shape of a printing press cylinder described by the body portion 23 of printing plate 22. The inward slopes described by the plates define angles complementary to the inward sloping outer surface 20 and the inward sloping outer portion 19' of the projecting edge at the leading and trailing edges, respectively, of the saddle 14.

The arcuate contour of the engaging means 24 and the corresponding anchoring means 16 at the leading edge are essential for meeting one of the objectives of the present invention, namely mounting plates without inching. Since the physical structure of the state-of-the-art printing machine provides a minimum amount of space for the operator to mount the printing plates, the present invention has proven beneficial in ease of mounting without having to rotate the cylinder (inch) during the mounting procedure. An application, the structure disclosed herein permits ease of loading in a more restricted area than does a plate that is, e.g., positioned over pins to effect mounting and centering. The arcuate mounting means disclosed herein also serve to center the printing plate on the support member. Although the use of a spring-mounted bar of the present invention may provide for locking of plates when the engaging and anchoring means assume other shapes, e.g., a 90°, 45° or 30° crimp, plates having crimps which do not define an arcuate contour, i.e., a substantially semicircular contour (with a correspondingly shaped anchoring means), are susceptible to misalignment or to bending or other damage to plates when attempt is made to engage the plates from a remote position to avoid press inching. However, by having an arcuate contour of the engaging and anchoring means 24 and 16, respectively, at the leading edge, the plates may be mounted after the press rolls are in a static position ready for final manipulations at the trailing edge. Moreover, the arcuate contour at both ends render the plates less susceptible to bending and damage during operation than the sharply crimped plates. In addition, fastening means are not required as for 90° crimped plates.

The printing plates may be mounted quickly and simply on the support employing one of the mounting means (hereinafter described) which are further embodiments of the present invention. The lock-up mechanism of the present invention provides for spring tension beyond finger manipulatability and, thus, requires some mechanical means for mounting. Mounting means of th present invention provides the necessary mechanical means and, moreover, facilitates quick mounting of the plates. The preferred mounting means is the center-pull cam activated spring-mounted bar actuating assembly 50, illustrated in its various aspects in FIGS. 10 through 14. Another mounting means is the laterally positioned spring-mounted bar actuating toggle means 75, illustrated in FIGS. 15 and 16.

FIG. 10 illustrates the center-pull, spring-mounted bar actuating assembly 50 which is mounted beneath the peripheral surface of the saddle 12 or cylinder 111. The spring-mounted bar actuating assembly 50 comprises a pivot arm 51 which, at one end, is operably connected to the spring-mounted bar 30 at its midpoint through a strap 52 and which, at the other end, protrudes from one lateral edge of the support and is competent to receive an activating means (hereinafter described). The pivot arm 51 floats in cavity 53 and is retained by pivot arm retaining means 54, pivotable about a pivot point 55 on pivot block 56. Suitable retaining means is a clip. Any means including a knife edge may be employed to provide a fulcrum or pivot point for the pivot arm. FIG. 12 taken along C—C in FIG. 10 shows the relationship among pivot arm 51, pivot block 56, pivot arm retaining means 54 and saddle 12. The strap 52, which is curved to the extent necessary to conform to the curvature of the saddle or cylinder, is immovably secured to the spring-mounted bar 30 by fastening means 57 and is connected to the pivot arm 51 by a pin 58 about which the pivot arm swivels in association with the pivoting action about pivot point 55. The pivot block 56 and pivot arm retaining means 54 are secured to the saddle 12 by fastening means 73 and 72, respectively. The end of pivot arm 51 which protrudes from the edge of the saddle has an orifice 59, adapted to receive an actuating means such as a cam tool 60 and abuts a cam block assembly 64.

The cam block assembly 64, mounted along one edge of the saddle 12, comprises an immovable support block 65 and a slideably adjustable cam block 66 connected by a fine adjustment means 67. The fine adjustment means is preferably a micrometer adjustment means but may also be any type adjustment screw such as a jack screw. The cam block assembly 64, as viewed from the side, may be seen in FIG. 11 which is a partial side view of a saddle showing the trailing edge 15, the spring-mounted bar 30 and the cam block assembly 64. The support block 65 is secured to the saddle with fastening means 68. The adjustable cam block 66, slideable along the edge of the support, is provided with a slot 69 and fastening means 70 for securing the block to the saddle 12 after appropriate adjustment has been made employing the adjustment means 67. The pivot arm 51 protrudes from edge of cavity 53 adjacent to the cam block 66. The position of the cam block 66 regulates the distance of the reciprocal motion of the pivot arm 51 and the travel limits of the spring-mounted bar 30 and, therefore, the maximum tension to be applied to a given type of plate and the allowable take-up to compensate for plate expansion.

FIGS. 13 and 14 show the side and end views of cam tool 60, comprising a cam 61, a cam shaft 62 and a cam handle 63.

When cam 61 is placed in orifice 59 of pivot arm 51 and cam shaft 62 is rotated by handle 63, a reciprocal motion is imparted to said pivot arm by the motion of said cam as the cam shaft rotates while maintained in position by block 66 against which the shaft abuts. The reciprocal motion of said pivot arm moves the springs 31 of the spring-mounted bar 30 between compressed and expanded positions for engaging the engaging means 25 of printing plate 22 with the anchoring means 17 on the spring-mounted bar 30. The cam tool 60 in position for operating the center pull spring-mounted bar actuating assembly is shown by the phantom lines in FIG. 11.

FIGS. 15 and 16 illustrate a second embodiment of a spring-mounted bar actuating device comprising two laterally positioned toggle means 75. Each toggle means comprises toggle arms 76 and 77 and a handle 78. The toggle arms are provided with fastening means 79 and 80 for engaging cocking pins 81 and 82, one pin being located on the spring-mounted bar 30 and the other on the saddle 12. The fastening means may be any means suitable for engaging pins; conveniently, they are hooks, as seen in FIGS. 15 and 16. The arms 76 and 77 are pivotally attached to the handle 78 at the points 83 and 84, respectively. The handle 78 is adapted to follow a rotatable cam surface 85 mounted on arm 77 for obtaining open and closed positions; the closed position of the toggle handle corresponds to the compressed position of the springs 31, as seen in FIG. 15, and the open position of the toggle handle corresponds to the expanded positions of the springs, as seen in FIG.16. When the springs 31 are in a compressed position, the spring-mounted bar 30 slides under the projecting edge 19 and the anchoring means 17 on the spring bar 30 is in a position to engaging means 25 of plate 22. When the springs 31 are in the expanded position, the engaging means 25 are in mating relationship to anchoring means 17 and the plate is locked in position.

In operation, the printing plate 22 may be locked to a saddle 12 or directly to a modified cylinder 111. When the printing plate 22 is to be locked to a saddle 12, the saddle may have been already mounted on a cylinder 11 or the printing plate first may be locked onto the saddle and the saddle thereafter mounted on the cylinder.

In illustrating the operation of the present invention, it will be assumed that the plate 22 is to be locked onto a saddle 12 already mounted on a cylinder 11. In an operation employing the center-pull, spring-mounted bar actuating assembly 50, the press rolls are rotated to position the saddle 12 so that its trailing edge 15 is in accessible position. Then, while maintaining the press rolls in a static condition, the engaging means 24 of printing plate 22 is then placed about the anchoring means 16 at the leading edge 14 of saddle 12 and the engaging means then is brought into interlocking contact with the anchoring means. Thereafter, the cam 61 of cam tool 60 is inserted in the orifice 59 of the pivot arm 51 and rotated until the springs 31 are in the compressed position and the spring bar 30 has been brought into close association with the body portion of the saddle 13, as seen in the phantom lines in FIG. 5. The engaging means 25 at the trailing edge of plate 22 is thereafter brought into engageable position with the anchoring means 17 of spring-mounted bar 30. The cam tool 60 is then further rotated until the springs 31 assume a more expanded position, moving the spring-mounted bar 30 away from the body portion 13 of the saddle, as seen in FIG. 5, whereupon printing plate 22 is locked to saddle 12, as seen in FIG. 4. Block 66, of the cam block assembly 64, may be adjusted with micrometer adjusting means 67 to provide the desired resilient tension suitable for the particular printing plate to be employed in press operation. During press operation, the spring bar 30 can slide away from the body portion of the saddle 13 exerting a constant urging force on the engaging means 25 at the trailing edge of the plate 22, keeping the plate free from stretch or slack. As the spring-mounted bar 30 slides away from the body portion of the saddle 13, the spring-mounted bar moves out and maintains a tangential relationship to the cylinderical surface of the saddle at 86, as seen in FIG. 4. At the point of tangential relationship of the spring-mounted bar 30 to the cylindrical surface, the distance between the surface of the cylinder and the surface of the plate is such as to prevent bobbing of the plate during press operation. Thus, the circumferential tension provided by the foregoing keeps the printing plate 22 securely locked to the saddle during high-speed operations.

In an operation employing the laterally positioned toggle means 75, the press rolls are rotated so that the trailing edge 15 of a saddle 12 is in accessible position. While the rolls are in static condition, the engaging means 24, at the leading edge of printing plate 22, is brought in engagement with the anchoring means 16 on the leading edge 14 of saddle 12. Thereafter, toggle arms 76 and 77 are placed on cocking pins 81 and 82 at the lateral edges of the spring-mounted bar 30 and saddle 12, respectively, and the spring-mounted bar 30 is brought to the compressed position of the spring-mounted 31, as shown in FIG. 15. The trailing edge of plate 22 is thereafter brought into engageable position with spring-mounted bar 30 and the engaging means 25 of plate 22 brought into contact with the anchoring means 17 on the spring bar 30. The toggle arms are released and the springs 31 assume a more expanded position moving the bar 30 away from the adjacent associated edge of the body portion 13 of the saddle, as shown in FIG. 16. thereby locking the printing plate 22 to saddlle 12. The operation is repeated at the other side of the saddle. The continuous resilient tension supplied by spring-mounted bar 30 and the tangential relationship the bar assumes with respect to the peripheral surface of the saddle 12 keeps the plate 22 locked to the saddle for high-speed operations.

The assembly can readily provide for a minimum spring pressure of about 50 pounds applied to the plate at its maximum expanded position. A maximum pressue of the order of 200 pounds readily provided by the use of 16 12.5-pound springs may be increased facilely by the use of heavier springs and/or more springs per assembly. When 16 12.5-pound springs are employed in the assembly, the normal locked-up position of the plate produces approximately 95 pounds pressure to the plate. These are pressures enabling locking of various flexible plates. Thus, the locking mechanism is capable of holding a 2-pound plate at 72,000 impressions per hour, at the allowable full extended position of the spring bar travel. Combination of above plate could include 0.025 thick etched half-tone plates or up to 0.040 thick etched plates with an appropriate percentage of open area.

While the invention has been described in conjunction with specific embodiments, it is to be understood that the present invention comprehends organization differing in form or detail from the presently described illustrative embodiments. Accordingly, the invention is not to be considered as limited save as in consonant with the scope of the following claims.

What is claimed is:

1. A means for securing a printing plate to a cylinder comprising: an arcuately-shaped support member fixedly disposed on said cylinder, said support member having a leading transverse edge and a lagging transverse edge parallel to the longitudinal axis of said cylinder, said cylinder having an outer circumferential surface; a projecting edge along said lagging edge forming a cavity bounded by said projecting edge and said circumferential surface; a plurality of springs positioned along said lagging edge within said cavity; a spring-mounted rectangular bar disposed within said cavity along the entire length of said projecting edge and against said circumferential surface and said support member, said bar being operably and non-detachably connected in a slideable relationship to said support member by said springs and operably connected in a slideable relationship to said cyliner by said sprins; arcuately shaped plate-anchoring means provided by a groove running along the entire length of said bar parallel to said lagging edge, said plate-anchoring means being adapted to receive and engage said printing plate in mating relationship whereby a printing plate may be selectively positioned on and attached to said cylinder; and retaining and guiding means comprising a slotted clip mounted beneath the lagging lateral edges of a modified body portion of the support and extending under the lateral edges of a modified spring-mounted bar wherein the slot in said clip is an elongated slot competent to receive an arresting means extending downward thereinto and to oscillate therealong and whereinn said modification comprises a reduction in thickness of said body portion and said bar at said lateral edges substantially equal to the thickness of said clip, and further comprises an incorporation of an arresting means in said bar.

2. A means for securing a printing plate to a cylinder comprising: an arcuately-shaped support member fixedly disposed on said cylinder, said support member having a leading transverse edge and a lagging transverse edge parallel to the longitudinal axis of said cylinder, said cylinder having an outer circumferential surface; a projecting edge along said lagging edge forming a cavity bounded by said projecting edge and said circumferential surface; a plurality of springs positioned along said lagging edge within said cavity; a spring-mounted rectangular bar disposed within said cavity along the entire length of said projecting edge and against said circumferential surface and said support member, said bar being operably and non-detachably connected in a slideable relationship to said support member by said springs and operably connected in a slideable relationship to said cylinder by said springs; arcuately shaped plate-anchoring means provided by a groove running along the entire length of said bar parallel to said lagging edge, said plate-anchoring means being adapted to receive and engage said printing plate in mating relaltionship whereby a printing plate may be selectively positioned on and attached to said cylinder; and a plate mounting means comprising a centrally positioned spring mounted bar actuating assembly mounted below the peripheral surface of said support.

3. An arrangement according to claim 2 wherein said centrally positioned spring bar actuating assembly comprises a pivot arm pivotable about a pivot block, said pivot arm at one end operably connected through a strap to the spring-mounted bar at a midpoint position of said bar, said pivot arm at the other end protruding from one lateral edge of the support and adapted to receive an actuating means, said actuating means co-acting with the pivot arm to impart reciprocal motion to said strap, and wherein said protruding edge of the pivot arm movably abuts and adjustable block of a block assembly mounted on one side of said support, said block abuttably regulating the reciprocal motion of the pivot arm.

4. An arrangement according to claim 3 wherein said block assembly comprises an immovable block and an adjustable block interconnected by a fine adjustment means, wherein said immovable block is secured to the edge of said support and wherein said adjustable block is slideable along the edge of said support to a predetermined distance and thereafter being competent to be secured to said support.

5. An arrangement according to claim 3 wherein said actuating means is a cam tool.

* * * * *